US006059505A

United States Patent [19]

Wang

[11] Patent Number: 6,059,505

[45] Date of Patent: May 9, 2000

[54] DEVICE FOR FORMING A LOOSE-LEAF HOLDER AND THE LOOSE-LEAF HOLDER FORMED THEREBY

[76] Inventor: Sheng-Tan Wang, 425 Chang Shui Road, Sec. 1, Hsi Hu Town, Changhua, Taiwan

[21] Appl. No.: 09/161,216

[22] Filed: Sep. 28, 1998

Related U.S. Application Data

[63] Continuation-in-part of application No. 08/796,373, Feb. 6, 1997, abandoned.

[51] Int. Cl.[7] ..... B42B 5/10

[52] U.S. Cl. ..... 412/39; 412/16; 412/38

[58] Field of Search ..... 412/38, 39, 40, 412/42, 43, 9–16; 281/21.1, 36

[56] References Cited

U.S. PATENT DOCUMENTS 5,197,842 3/1993 Bross ..... 412/39
5,497,811 3/1996 Pigna ..... 412/39

*Primary Examiner*—Willmon Fridie, Jr.
*Attorney, Agent, or Firm*—Rabin & Champagne, P.C.

[57] ABSTRACT

A device for forming a loose-leaf holder of the loose0leaf notebook is composed of a cutting tool seat, a press seat, a locating seat, a position confining seat, a support arm, a sliding seat, a fastening seat, two rotating rods, a linking rod, and five cams. The device is capable of forming a loose-leaf holder which has two curved ends pointing towards each other such that the curved ends are prevented from making contact with a person's skin.

1 Claim, 12 Drawing Sheets

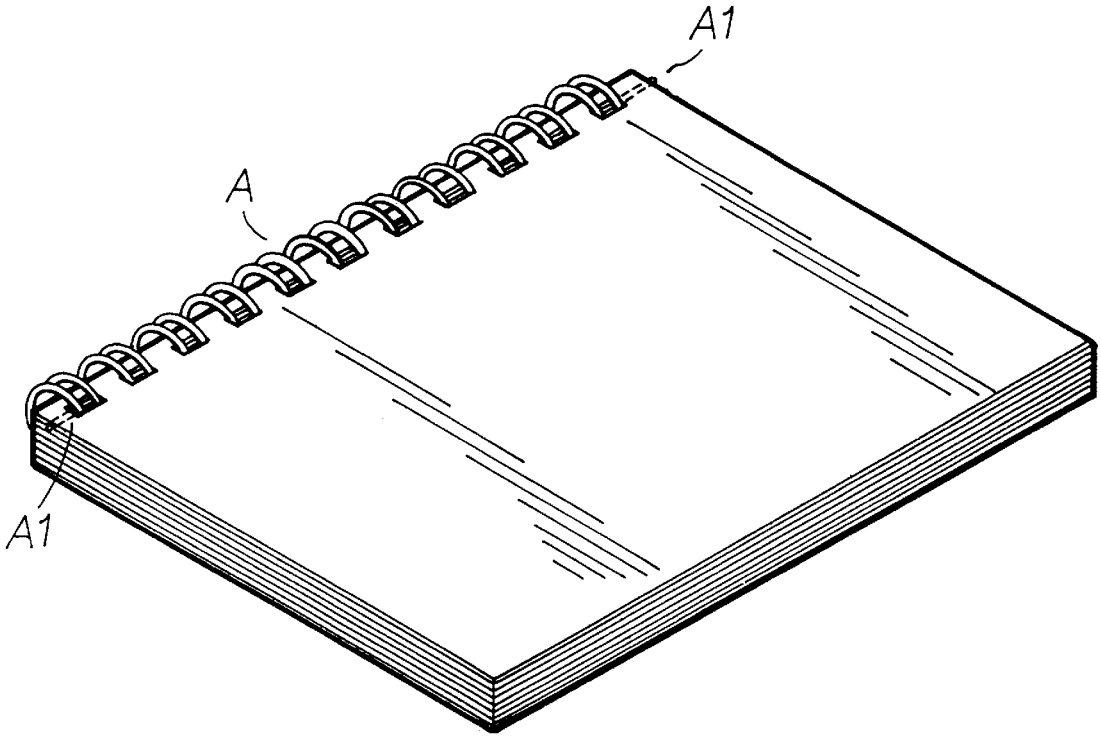
FIG.1-A(PRIOR ART)
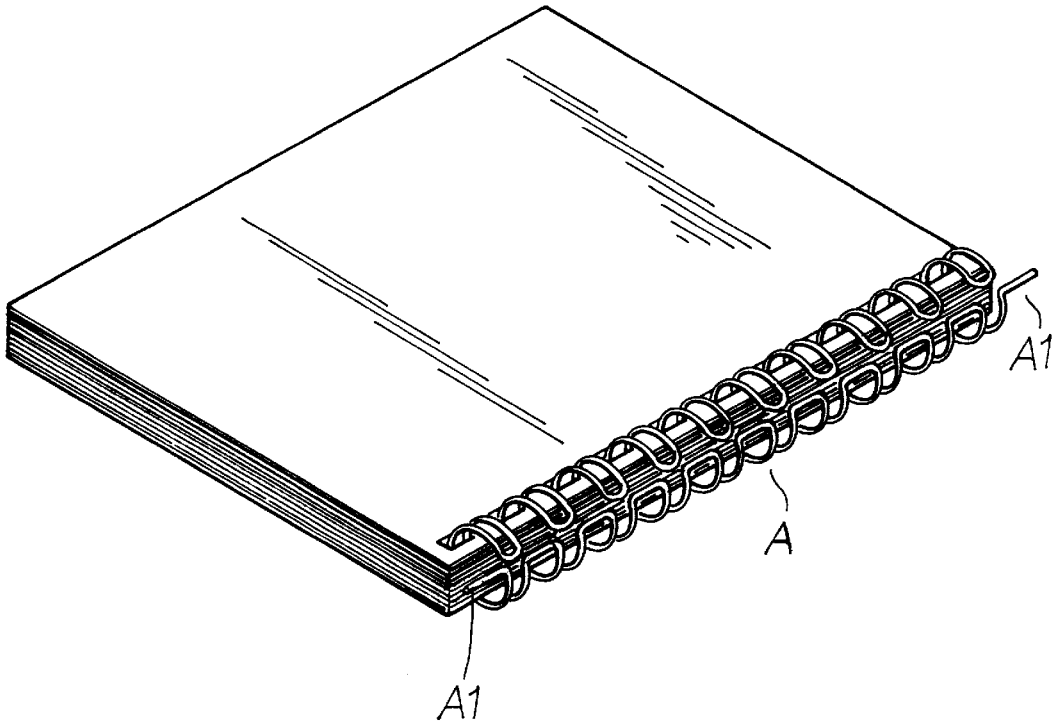
FIG.1-B(PRIOR ART)

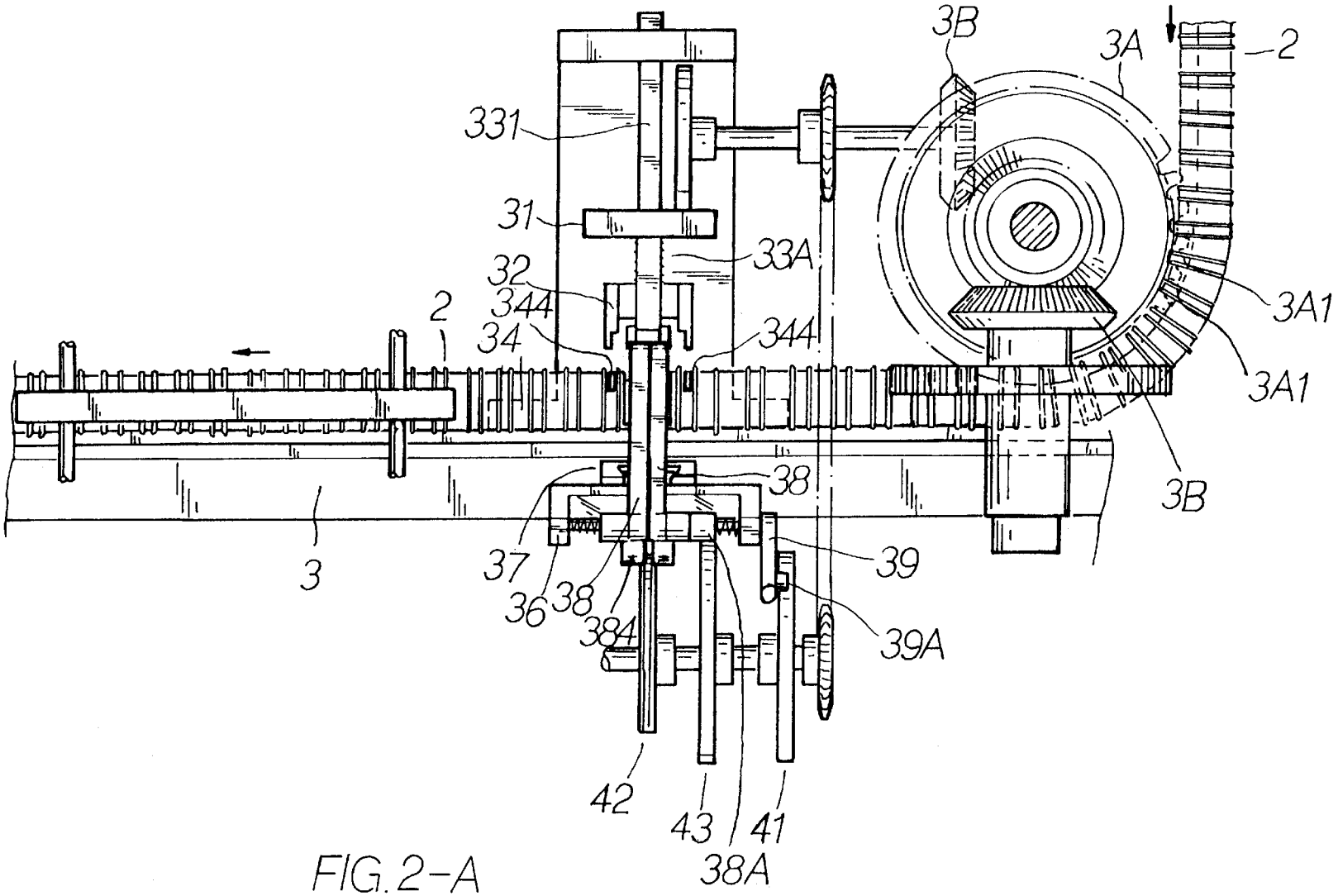
FIG. 2-A

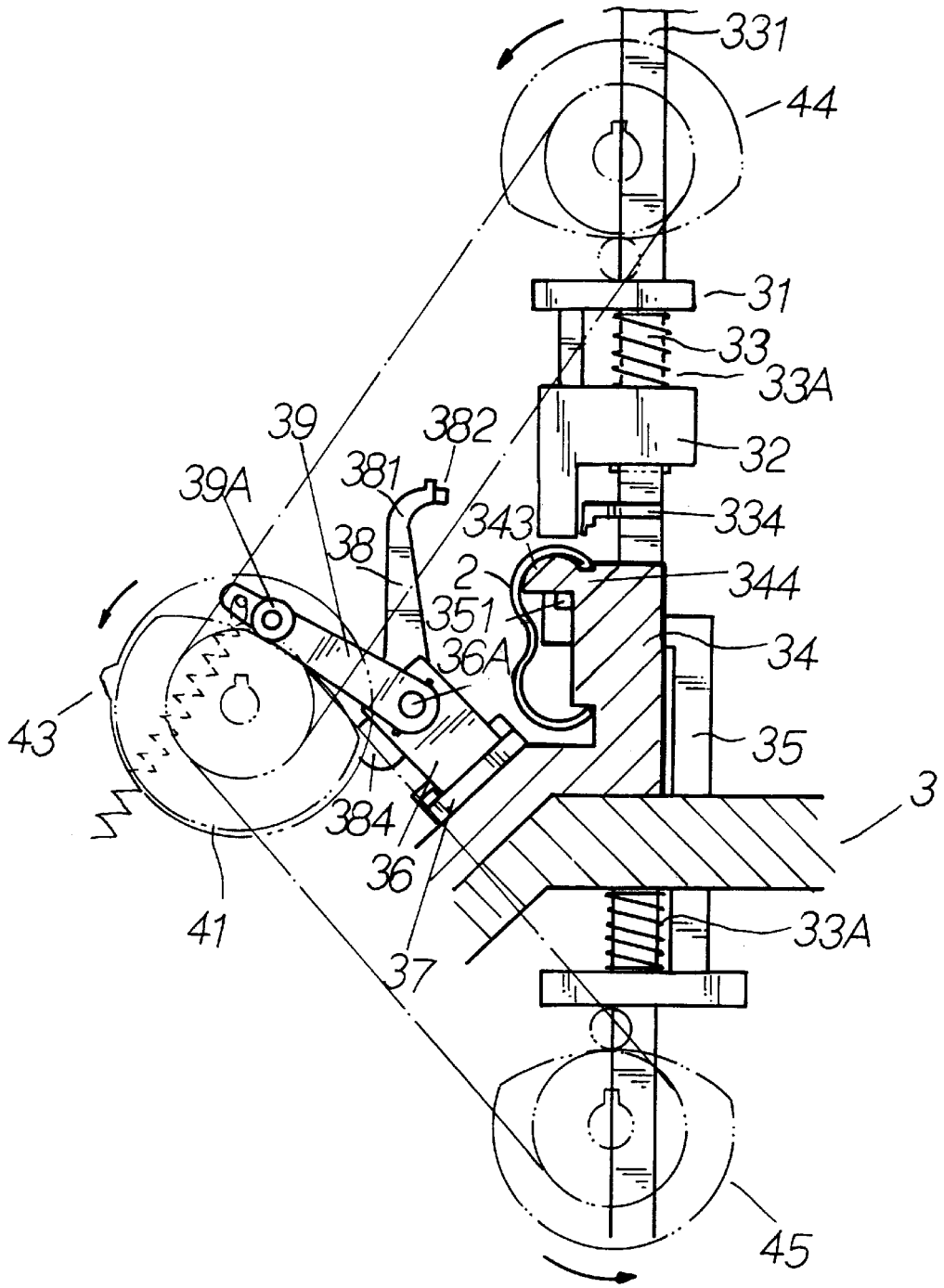
FIG. 2-B

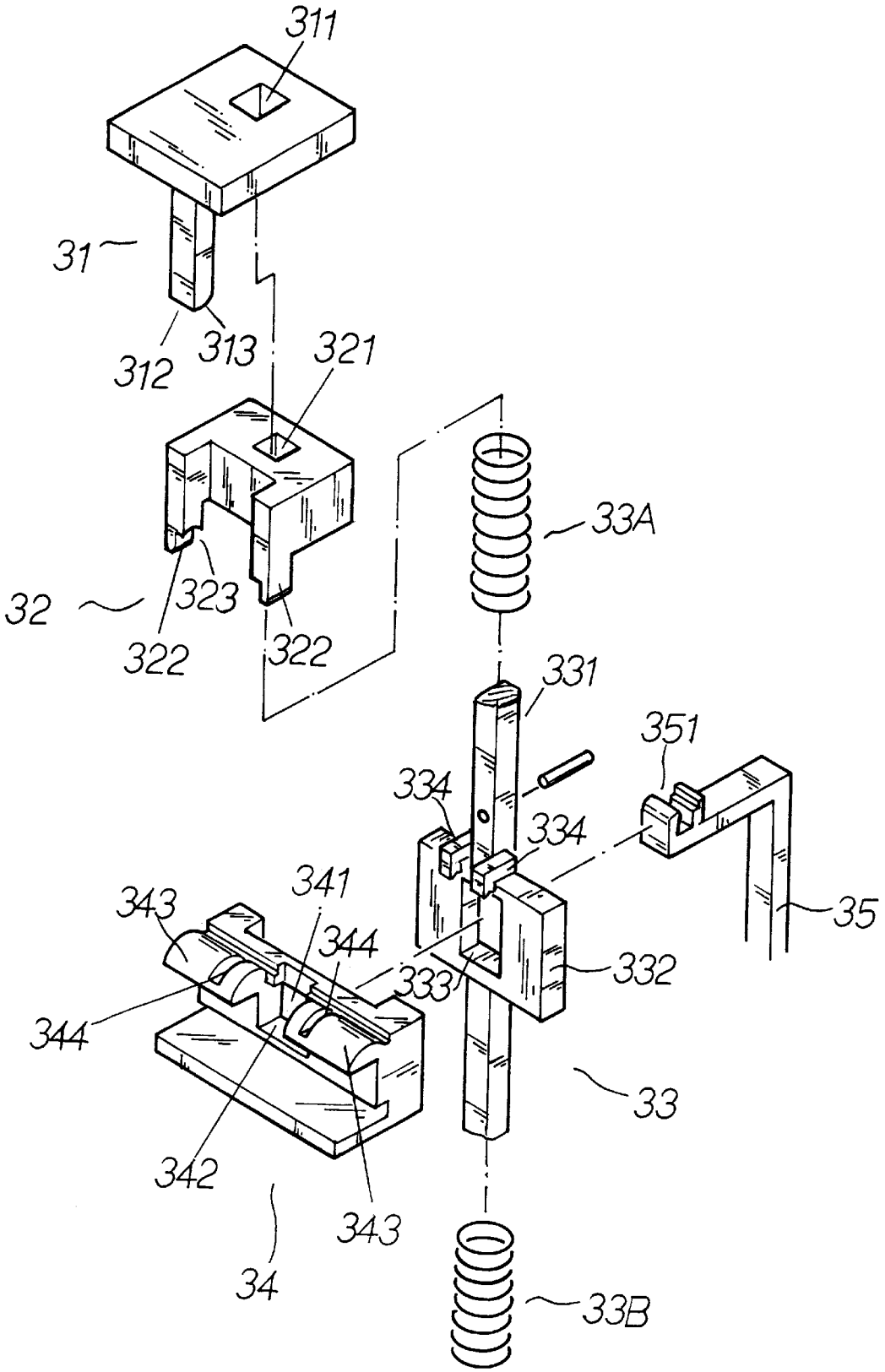
FIG.3-A

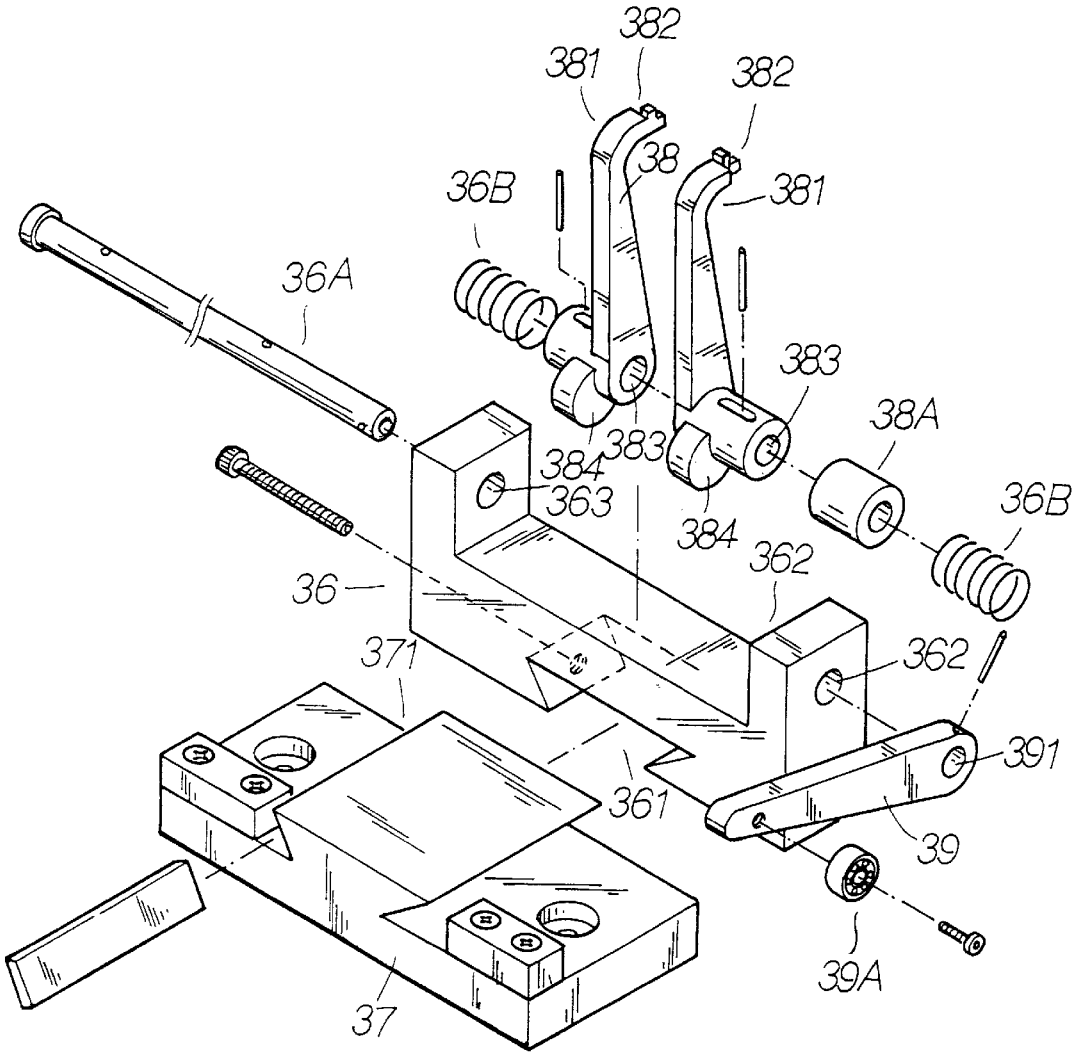
FIG. 3-B

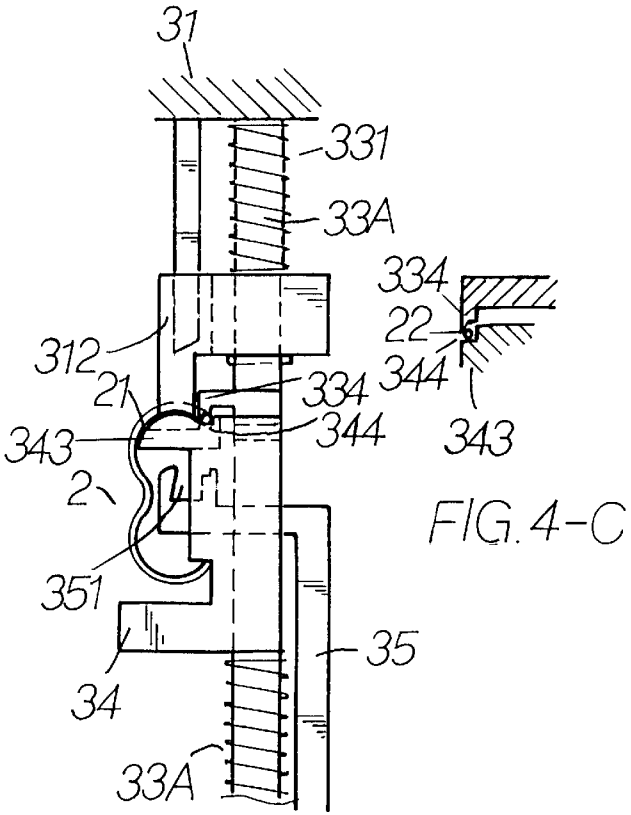
FIG. 4-C
FIG. 4-B
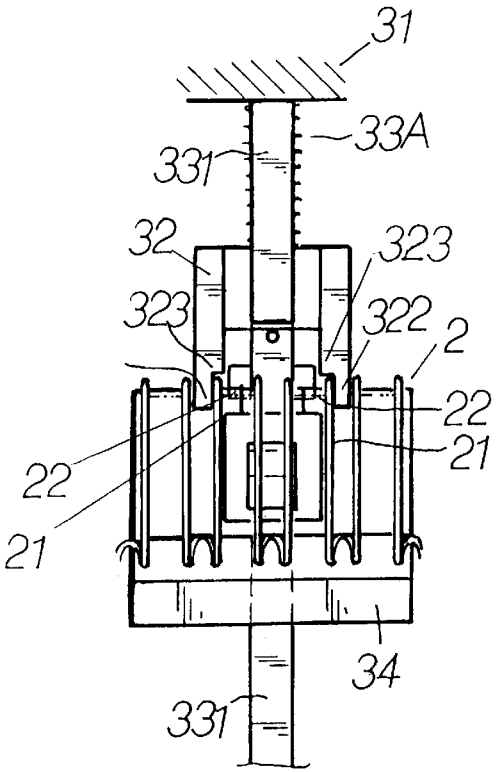
FIG. 4-A
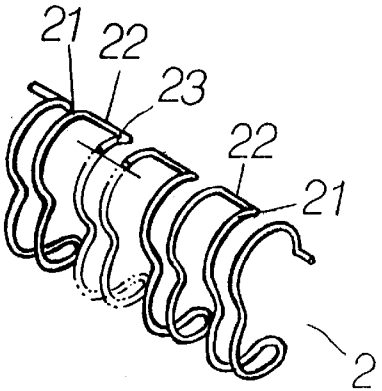
FIG. 4-D

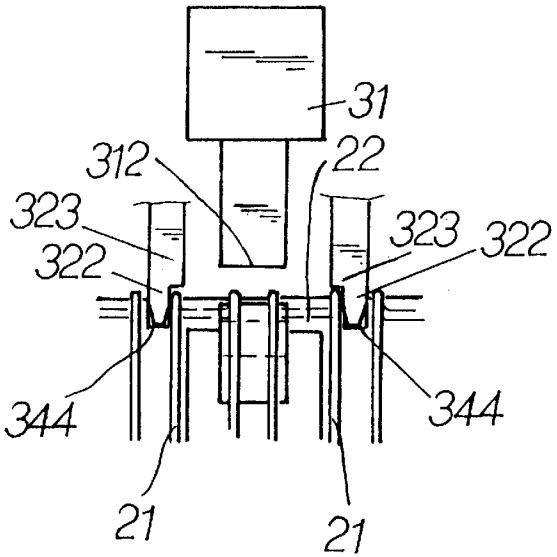
FIG. 5-A
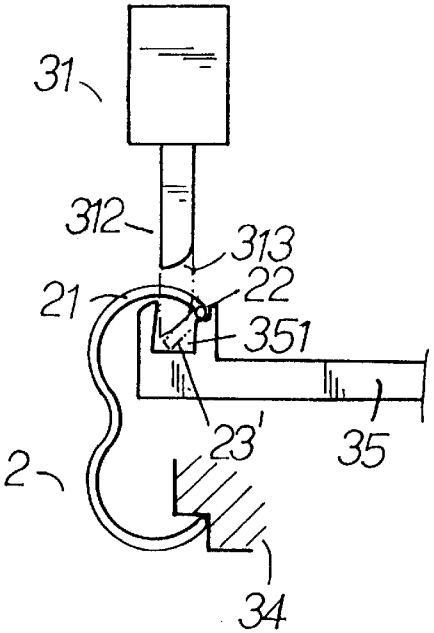
FIG. 5-B
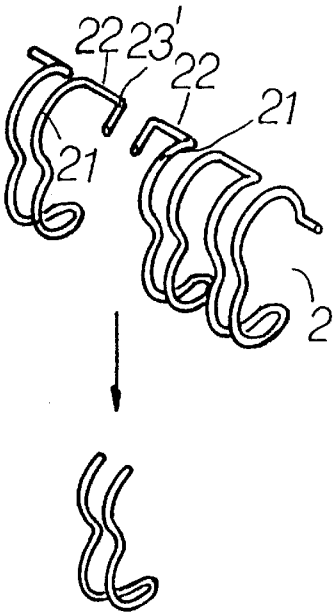
FIG. 5-C

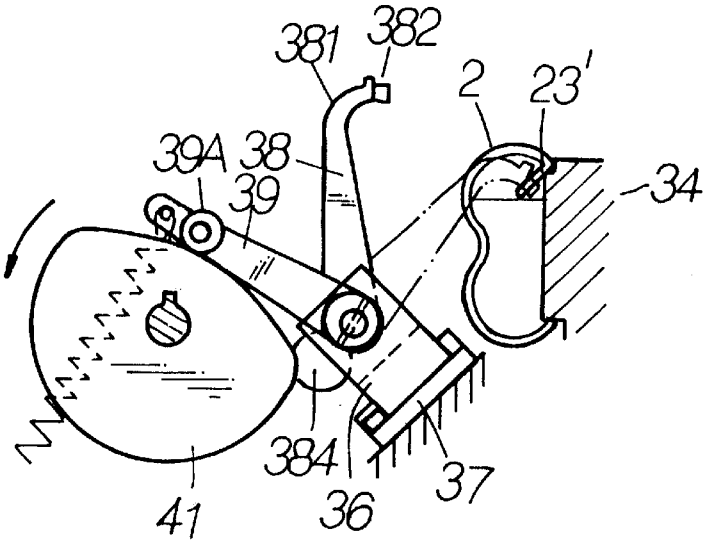
FIG.6-B
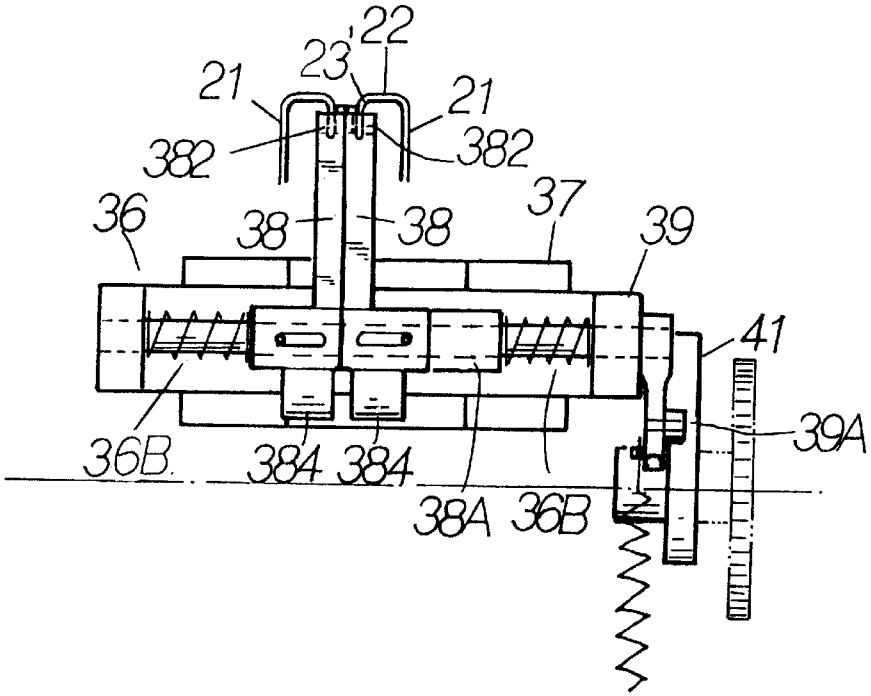
FIG.6-A

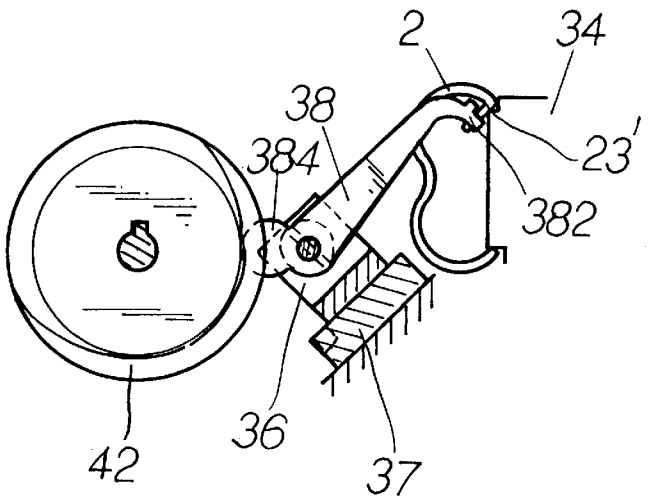
FIG. 6-D
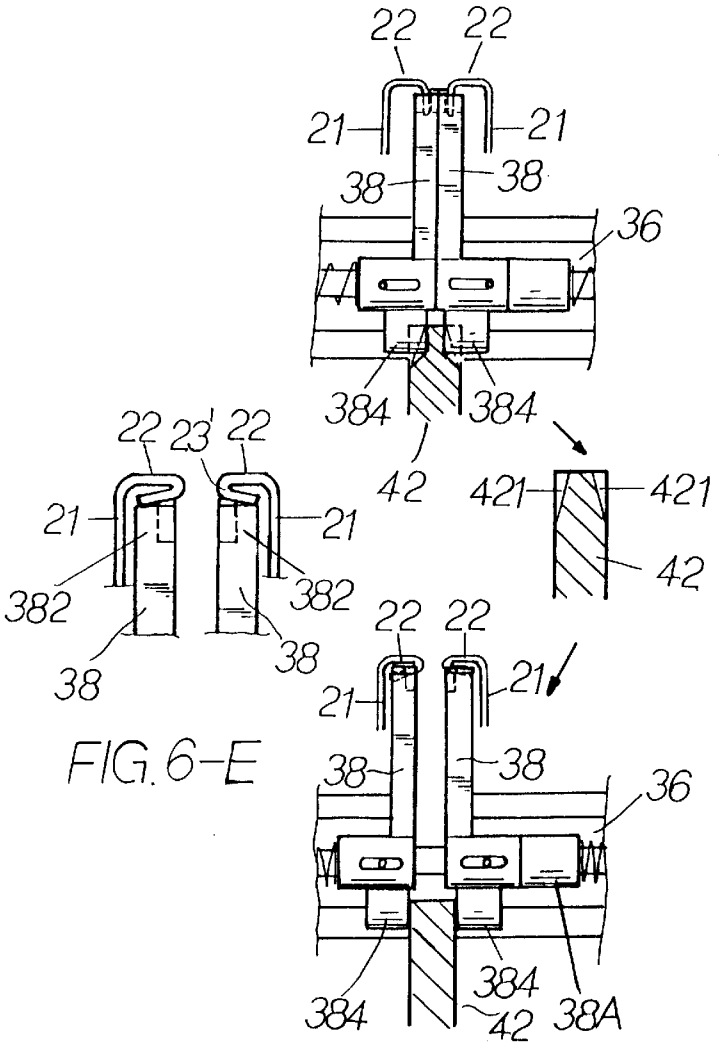
FIG. 6-E
FIG. 6-C

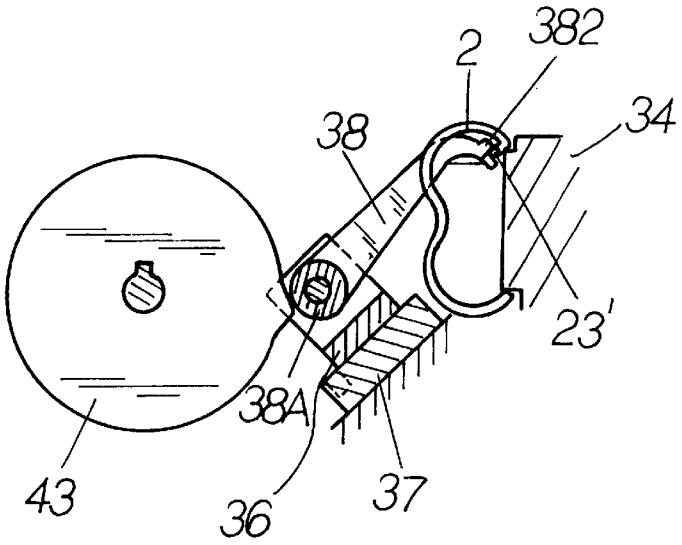
FIG. 7–A
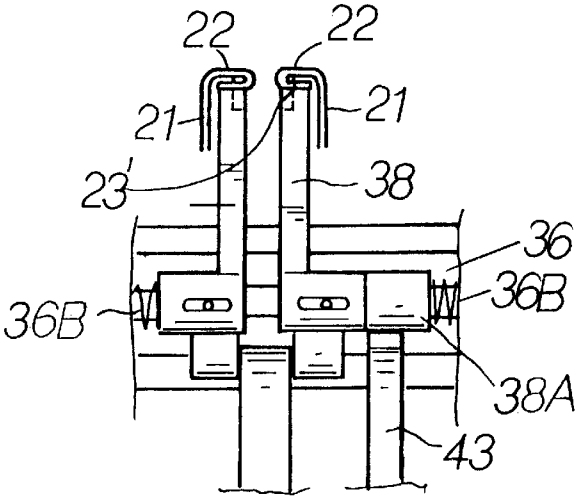
FIG. 7–B
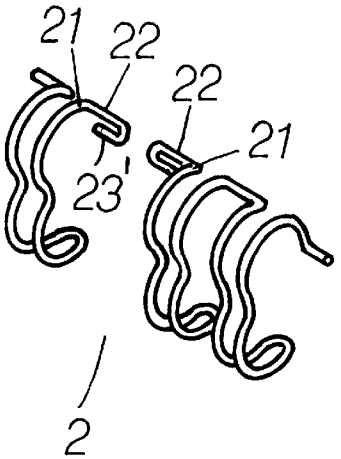
FIG. 7–C

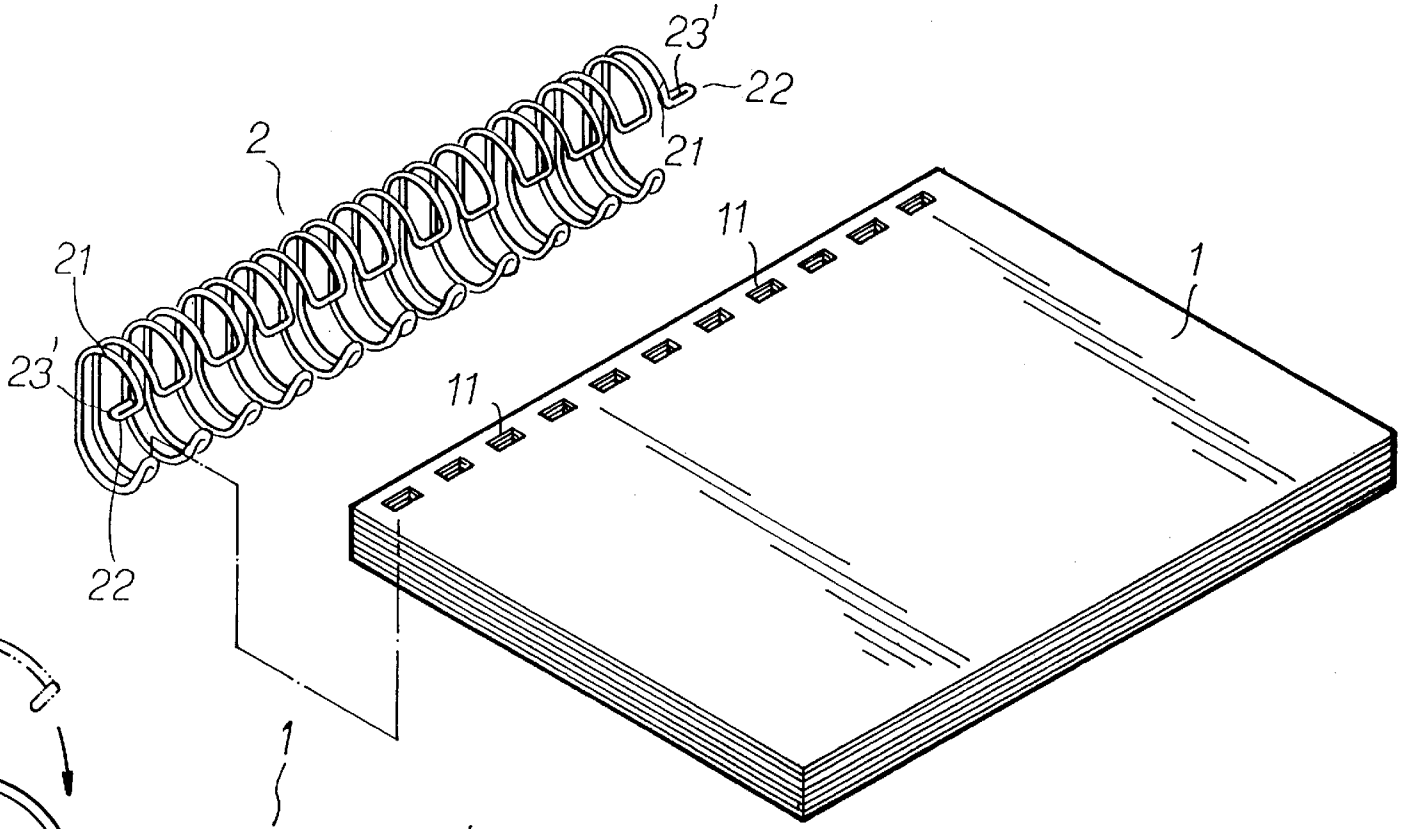
FIG. 8-A
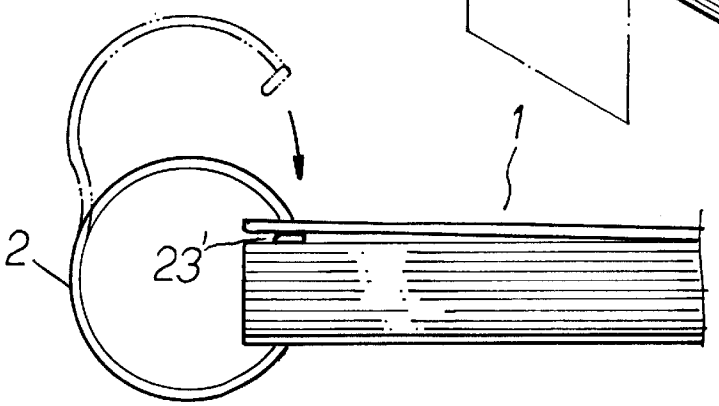
FIG. 8-B

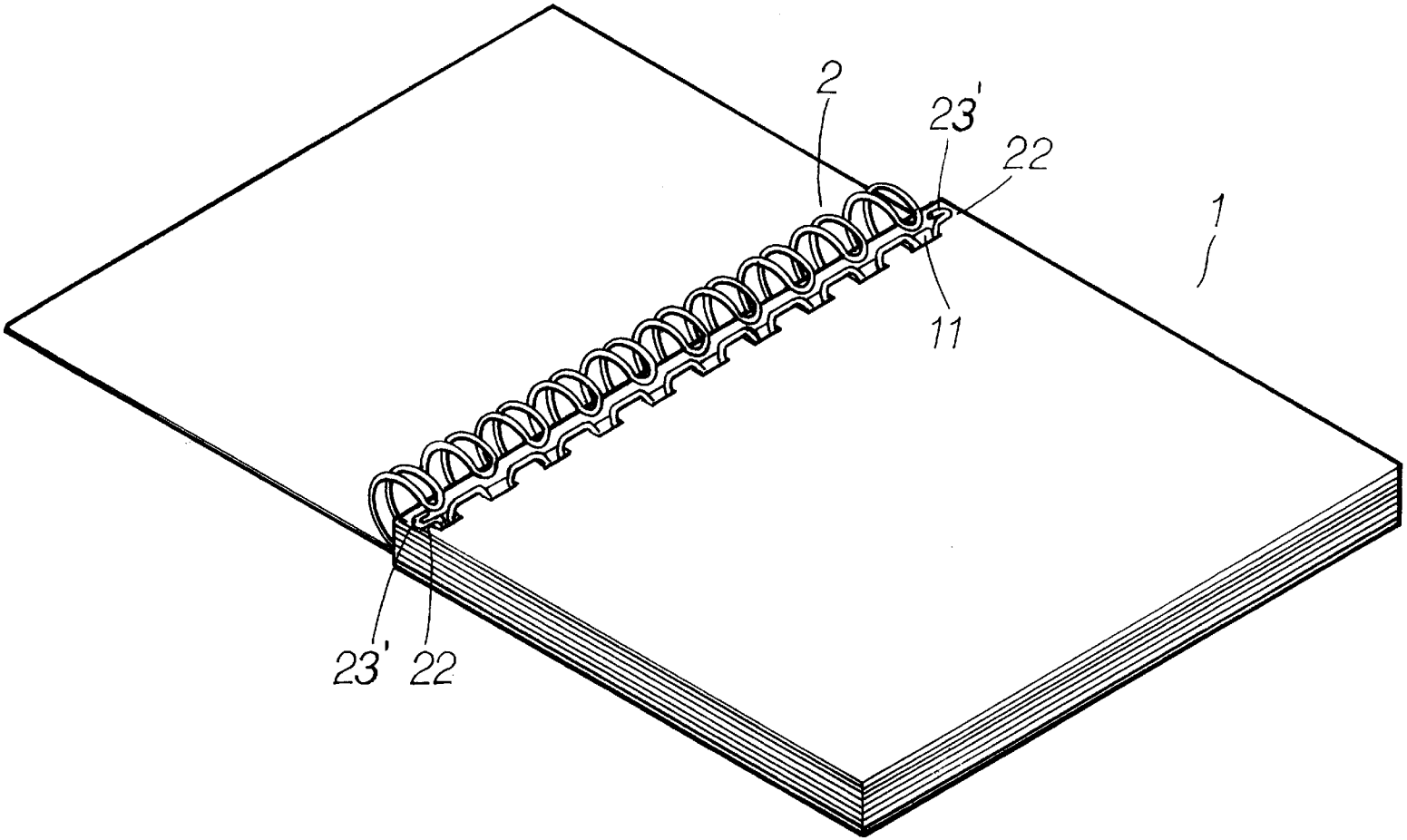
FIG. 8-C

DEVICE FOR FORMING A LOOSE-LEAF HOLDER AND THE LOOSE-LEAF HOLDER FORMED THEREBY

This application is a continuation-in-part of U.S. patent application Ser. No. 08/796,373 filed on Feb. 6, 1997 now abandoned.

FIELD OF THE INVENTION

The present invention relates generally to a loose-leaf holder, and more particularly to a device for forming the loose-leaf holder. This application is a continuation in part of Ser. No. 08/796,373 now abandoned.

BACKGROUND OF THE INVENTION

As shown in FIGS. 1-A and 1-B, a loose-leaf holder "A" of the prior art has two ends "A1" pointing in opposite directions. The loose-leaf holder "A" is longer than the loose leaves. In addition, both ends "A1" are not further finished to eliminate the sharp edges which can inflict a wound on a person's skin. In view of the length of the loose-leaf holder "A" of the prior art, both ends "A1" of the prior art loose-leaf holder "A" are sources of trouble, annoyance, and inconvenience at best.

SUMMARY OF THE INVENTION

The primary objective of the present invention is therefore to provide a device for forming a loose-leaf holder free from the shortcomings of the prior art loose-leaf holder described above.

In keeping with the principle of the present invention, the foregoing objective of the present invention is attained by the device capable of forming a loose-leaf holder which has two curved ends pointing towards each other such that the curved ends are prevented from making contact with a person's skin so as to enhance the safety of the user of the loose-leaf holder.

The objective, features, functions and advantages of the present invention will be more readily understood upon a thoughtful deliberation of the following detailed description of the present invention with reference to the accompanying drawings.

BRIEF DESCRIPTION OF THE DRAWINGS

FIG. 1-A shows a schematic view of a loose-leaf notebook consisting of a loose-leaf holder of the prior art.

FIG. 1-B shows another schematic view of the loose-leaf notebook as shown in FIG. 1-A.

FIG. 2-A shows a front elevational view of a device embodied in the present invention for forming a loose-leaf holder.

FIG. 2-B shows a partial enlarged side view of the device of the present invention.

FIG. 3-A shows an exploded view of locating, cutting, and bending elements of the device of the present invention.

FIG. 3-B shows an exploded view of bending and forming elements of the device of the present invention.

FIG. 4-A shows a front view of the locating mechanism of the device of the present invention.

FIG. 4-B shows a side view of the locating mechanism of the device of the present invention.

FIG. 4-C shows a partial enlarged view of the locating mechanism of the device of the present invention.

FIG. 4-D shows a partial perspective view of an unfinished loose-leaf holder formed by the device of the present invention.

FIG. 5-A shows a front view of the cutting mechanism of the device of the present invention at work.

FIG. 5-B shows a side view of the cutting mechanism of the device of the present invention at work.

FIG. 5-C shows a partial perspective view of a semifinished loose-leaf holder formed by the device of the present invention.

FIG. 6-A shows a front view of the rotating rods of the device of the present invention in stationary state.

FIG. 6-B shows a side view of the rotating rods of the device of the present invention in stationary state.

FIG. 6-C shows a schematic view of the rotating rods of the device of the present invention at work.

FIG. 6-D shows a side view of the rotating rods of the device of the present invention at work.

FIG. 6-E shows a partial enlarged view of the rotating rods of the device of the present invention at work.

FIG. 7-A shows a front view of the rotating rods of the device of the device of the present invention in motion.

FIG. 7-B shows a side view of the rotating rods of the device of the present invention in motion.

FIG. 7-C shows a partial perspective view of a finished loose-leaf holder formed by the device of the present invention.

FIG. 8-A shows a complete perspective view of a finished loose-leaf holder formed by the device of the present invention.

FIG. 8-B shows a partial schematic view of the finished loose-leaf holder of the present invention in combination with a plurality of loose leaves to form a loose-leaf notebook.

FIG. 8-C shows a perspective view of a loose-leaf notebook consisting of the loose-leaf holder formed by the device of the present invention.

DETAILED DESCRIPTION OF THE INVENTION

As shown in FIGS. 2–8, a device 3 embodied in the present invention is intended to form a loose-leaf holder 2 which is used to hold together the loose leaves of a loose-leaf notebook 1, as shown is FIG. 8-C. The loose leaves of the loose-leaf notebook 1 are provided with a plurality of holes 11 arranged along the edge of one side of the loose leaves. The loose-leaf holder 2 is received in the holes 11 of the loose leaves.

The device 3 is composed of a cutting tool seat 31, a press seat 32, a locating seat 33, a position confining seat 34, a support arm 35, a sliding seat 36, a fastening seat 37, two rotating rods 38, a linking rod 39, and five cams 41, 42, 43, 44 and 45. In addition, the device 3 is provided with a toothed disk 3A which is driven by a motor 5 (not shown in the drawings ) to turn so as to feed an unfinished loose-leaf holder 2 by means of a plurality of gullets 3A1 of the toothed disk 3A, as shown in FIG. 2-*a*. The operation of the toothed disk 3A is assisted by two transmission gears 3B.

The cutting tool seat 31 is provided with an opening 311 and a blade 312 having an arcuate portion 313.

The press seat 32 is provided with an opening 321 and two protrusions 322 each having a depression 323 for securing the unfinished loose-leaf holder 2.

The locating seat 33 is composed of an upright rod 331, a cross plate 332, and an opening 333 located at the junction of the upright rod 331 and the cross plate 332. The upright rod 331 is fitted into a coil spring 33*a* and is received in the opening 311 of the cutting tool seat 31 and the opening 321 of the press seat 32 such that the press seat 32 is located under the cutting tool seat 31. The lower segment of the upright rod 331 is fitted into a coil spring 33B. The cross plate 332 is provided with two locating blocks 334.

The position confining seat 34 is provided with an opening 341, two bracing portions 343, and a cut 342 located between the two bracing portions 343 each having a slot 344.

The support arm 35 is of an inverted L-shaped construction and is provided at one end thereof with a receiving port 351. The support arm 35 is received in the opening 333 of the locating seat 33 and the opening 341 of the position confining seat 34.

The sliding seat 36 is provided in the underside thereof with a dovetail slot 361, in the upper side thereof with an opening 362 which is defined by two opposite walls each having a round through hole 363 in which a shaft 36A is received such that both ends of the shaft 36A are fitted into two coil springs 36B and 36C, as shown is FIG. 3-B.

The fastening seat 37 is provided in the upper surface thereof with a dovetail block 371 which is engaged with the dovetail slot 361 of the sliding seat 36 capable of sliding. The fastening seat 37 is fastened with a work platform of the device 3.

The two rotating rods 38 are provided at the fastening end thereof with a through hole 383, at the curved end 381 thereof with an opening 382, and a protuberance 384 located under the through hole 383. The two rotating rods 38 are fastened with the shaft 36A such that the shaft 36A is received in the through holes 383 of the two rotating rods 38.

The linking arm 39 is provided at one end thereof with a fastening hole 391 having a pin hole. The linking arm 39 is fastened with one end of the shaft 36A such that the one end of the shaft 36A is secured in the fastening hole 391 by means of a fastening pin which is received in the pin hole of the fastening hole 391 and a pin hole of the one end of the shaft 36A. The linking arm 39 is further provide at other end thereof with a threaded through hole for fastening a bearing 39A by means of a fastening bolt which is engaged with the threaded through hole.

The first cam 41 is intended to actuate the rotating rods 38 to swivel, whereas the second cam 42 is used to cause the two rotating rods 38 to displace. The third cam 43 is capable of driving a sleeve 38A of the rotating rods 38 so as to cause the sliding seat 36 to slide. The fourth cam 44 is used to drive the cutting tool seat 31 to move along the upright rod 331 of the locating seat 33. The fifth cam 45 is intended to drive the support arm 35 to displace.

In operation, the unfinished loose-leaf holder 2 is cut by the blade 312 such that arcuate portions 23 of the unfinished loose-leaf holder 2 are severed, as shown in FIG. 4-D. The arcuate portions 23 are then pressed by the arcuate portion 313 of the blade 312 such that the arcuate portions 23 are transformed into the straight portions 23', as shown in FIG. 5-C. The linking arm 39 is driven by the first cam 41 via the bearing 39A so as to actuate the rotating rods 38, as shown in FIGS. 6A and 6B. The second cam 42 is in contact with the protuberance 384, as shown in FIG. 6D. As a result, when the second cam 42 is turned, the protuberances 384 of the rotating rods 38 are urged by a trapezoidal surface 421 of the second cam 42, thereby resulting in the bending of the straight portions 23', as shown in FIGS. 6C and 6E. The sliding seat 36 is driven by the third cam 43 to displace, as shown in FIGS. 7A and 7B, thereby causing the straight portions 23' of both ends 21 of the unfinished loose-leaf holder 2 to move to be near each other, as shown in FIG. 7C. The finished loose-leaf holder 2 is of a C-shaped construction and can be therefore put through the holes 11 of the loose leaves 1, as shown in FIGS. 8-A, 8-B and 8-C. The straight portions 23 of the finished loose-leaf holder 2 of the present invention are bent such that both sharp ends of the loose-leaf holder 2 point towards each other so as to prevent them from inflicting a wound on a person's skin.

What is claimed is:

1. A device for forming a loose-leaf holder, said device comprising:

a cutting tool seat provided with an opening and a blade having an arcuate portion;

a press seat provided with an opening and two protrusions each having a depression for securing an unfinished loose-leaf holder;

a locating seat composed of an upright rod, a cross plate, and an opening located at a junction of said upright rod and said cross plate, said upright rod being fitted into a coil spring and being received in said opening of said cutting tool seat and said opening of said press seat such that said press seat is located under said cutting tool seat, said upright rod having a lower segment which is fitted into a coil spring, said cross plate provided with two locating blocks;

a position confining seat provided with an opening, two bracing portions, and a cut located between said two bracing portions each having a slot;

a support arm of an inverted L-shaped construction and provided at one end thereof with a receiving port, said support arm being received in said opening of said locating seat and said opening of said position confining seat;

a sliding seat provided in an underside thereof with a dovetail slot, and in an upper side thereof with an opening which is defined by two opposite walls each having a round through hole in which a shaft is received such that both ends of said shaft are fitted into two coil springs;

a fastening seat provided in an upper surface thereof with a dovetail block which is engaged with said dovetail slot of said sliding seat which is fastened with a work platform of said device;

two rotating rods provided at a fastening end thereof with a through hole, at a curved end thereof with an opening, and a protuberance located under said through hole, said two rotating rods being fastened with said shaft such that said shaft is received in said through holes of said two locating rods;

a linking arm provided at one end thereof with a fastening hole having a pin hole, said linking arm fastened with one end of said shaft such that said one end of said shaft is received securely in said fastening hole by a fastening pin which is received in said pin hole of said fastening hole and a pin hole of one end of said shaft, said linking arm further provided at another end thereof with a threaded through hole;

a first cam for actuating said rotating rods to swivel;

a second cam for driving said two rotating rods to displace;

a third cam for driving a sleeve of said rotating rods so as to cause said sliding seat to slide;

a fourth cam for driving said cutting tool seat to move along said upright rod of said locating seat; and a fifth cam for driving said support arm to displace.

* * * * *